United States Patent [19]

Lindal

[11] 4,107,885

[45] Aug. 22, 1978

[54] PREFABRICATED ROOF SECTION

[76] Inventor: Sir Walter Lindal, 1120 8th Ave., #1201, Seattle, Wash. 98101

[21] Appl. No.: 703,644

[22] Filed: Jul. 8, 1976

[51] Int. Cl.[2] ..... E04B 7/02; E04D 1/00

[52] U.S. Cl. ..... 52/90; 52/521; 52/535; 52/539; 52/540; 52/541; 52/550; 52/560; 52/595; 52/552

[58] Field of Search ..... 52/90, 92, 300, 560, 52/543, 550, 551, 521, 549, 552, 541, 540, 539, 536, 535, 533, 595

[56] References Cited

U.S. PATENT DOCUMENTS

| | | | |
|---|---|---|---|
| 1,917,930 | 7/1933 | Fischer | 52/748 X |
| 2,285,480 | 6/1942 | Wilde | 52/540 |
| 2,384,686 | 9/1945 | Kraus | 52/540 |
| 2,390,087 | 12/1945 | Fink | 52/539 X |
| 2,394,380 | 2/1946 | Herbes | 52/748 |
| 2,892,192 | 6/1959 | Thyer | 52/748 |
| 2,895,181 | 7/1959 | Hope et al. | 52/560 |
| 2,935,768 | 5/1960 | Roupe | 52/560 X |
| 3,095,671 | 7/1963 | Fink et al. | 52/551 |
| 3,262,239 | 7/1966 | Mills | 52/541 X |
| 3,333,384 | 8/1967 | Brady | 52/560 X |
| 3,440,777 | 4/1969 | Martin | 52/551 X |
| 3,546,843 | 12/1970 | Luebs | 52/560 X |
| 3,665,662 | 5/1972 | Timbrook et al. | 52/92 |
| 3,908,326 | 9/1975 | Francis | 52/541 X |
| 4,028,450 | 6/1977 | Gould | 52/560 X |

FOREIGN PATENT DOCUMENTS

| | | | |
|---|---|---|---|
| 507,299 | 11/1954 | Canada | 52/539 |
| 77,857 | 8/1949 | Czechoslovakia | 52/539 |
| 1,458,233 | 7/1965 | France | 52/92 |
| 636,231 | 7/1933 | Fed. Rep. of Germany | 52/92 |
| 2,429,416 | 1/1976 | Fed. Rep. of Germany | 52/90 |
| 1,042,993 | 9/1966 | United Kingdom | 52/552 |

OTHER PUBLICATIONS

American Builder, Aug. 1936, p. 332.

*Primary Examiner*—Leslie Braun
*Attorney, Agent, or Firm*—Christopher Duffy

[57] ABSTRACT

The roof section comprises a quadrilateral substrate and a roof covering on the top thereof. The covering comprises shingle-like roof plates, the bodies of which have a tapering cross section in one cross sectional plane thereof. The plates are arranged in at least two elongated parallel, relatively transversely offset but overlapping relatively top and bottom series. Each series has a plurality of the plates, and the plates are arranged in each series so that the bodies of the plates are staggered in overlapping relationship to one another lengthwise of the series. Also, the tapering cross sections of the plates are disposed lengthwise of the series. The series are arranged between unidirectional edges of the substrate so that a relatively top series forms a projecting lip along one of the edges and a relatively bottom series forms a complimentary shoulder along the other edge, to enable a plurality of the sections to be abutted edge to edge of one another in coplanar array, with a waterproof lap joint thus formed between them.

34 Claims, 9 Drawing Figures

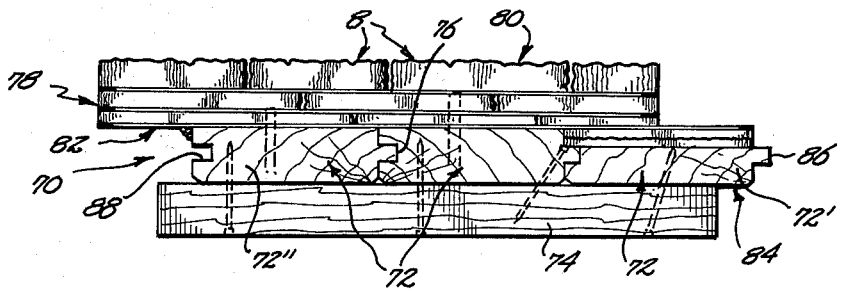
Fig. 5
Fig. 6.
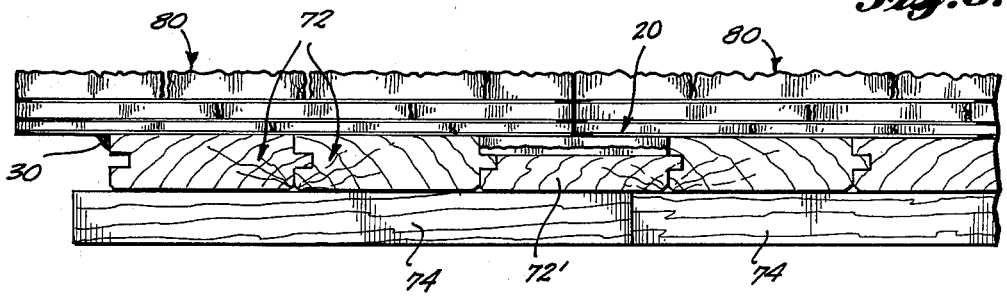
Fig. 7.
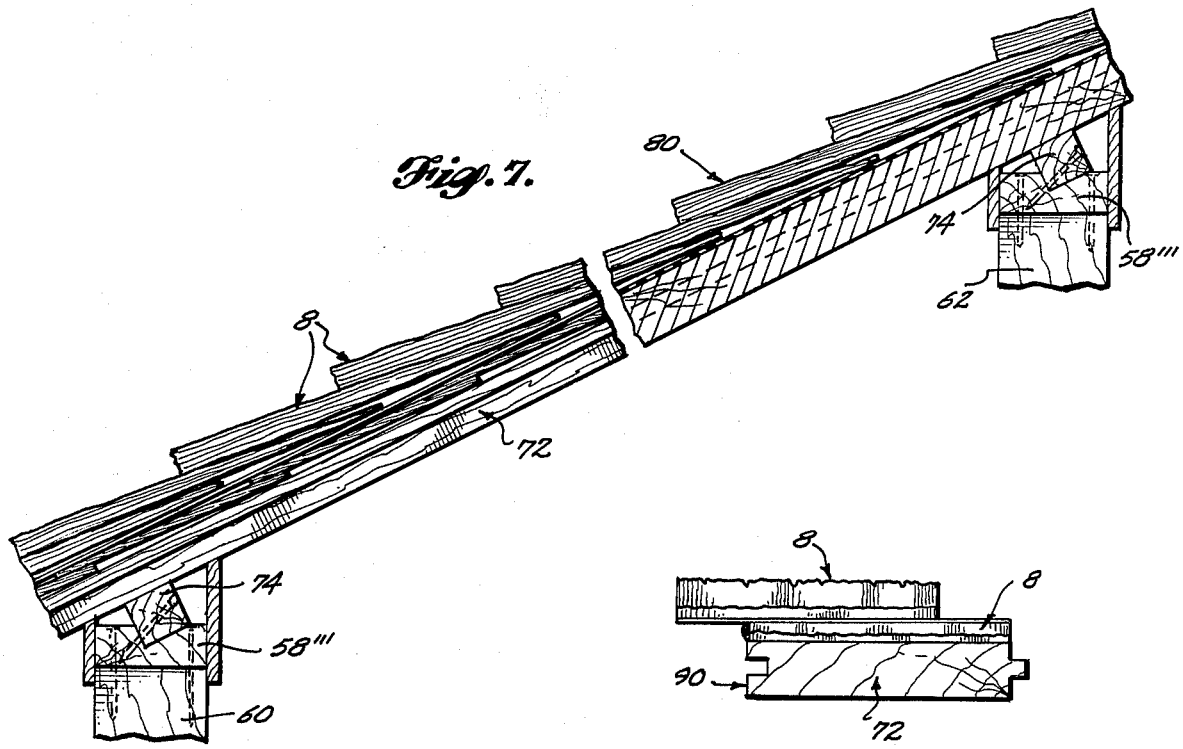
Fig. 8.
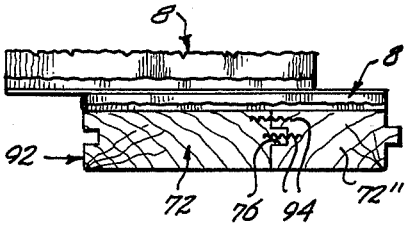
Fig. 9.

PREFABRICATED ROOF SECTION

THE INVENTION IN GENERAL

This invention relates to a prefabricated roof section which has a roof covering thereon comprised of shingle-like roof plates that are incorporated in such a way that they can be interengaged with one another to form a waterproof lap-joint between each pair of adjacent sections when a plurality of the sections are obliquely mounted on a building structure and abutted edge to edge of one another crosswise of the slope. The invention also relates to a means and technique for obliquely mounting and securing the prefabricated roof section to a building structure from points below the roof section, that is, from points disposed within the building structure itself. Additionally, the invention relates to a prefabricated roof section of this nature which combines in a single unit, not only the roof covering for a building structure, but also components which are normally prefabricated in the structure itself, such as framing, insulation, and inside finish for the roof. Thus, when a plurality of the roof sections are mounted on the structure and abutted edge to edge of one another crosswise of the slope, the operation accomplishes in one step what is conventionally done in a series of separate operations, each of which normally requires separate scaffolding to accomplish it.

Other advantages and objectives of the invention will become apparent as it is described hereinafter.

According to the invention, the roof section comprises a substrate of stiff sheathing-like material having a quadrilateral outline and a roof covering on the top thereof. The roof covering comprises a plurality of shingle-like roof plates, the bodies of which have a tapering cross section in one cross sectional plane thereof. The plates are arranged on the substrate in at least two elongated parallel, relatively transversely offset but overlapping relatively top and bottom series, each of which has a plurality of the plates therein. The plates are arranged in each series so that the bodies of the plates are staggered in overlapping relationship to one another lengthwise of the series and the tapering cross sections of the plates are disposed lengthwise of the series. Also, the series are arranged between unidirectional edges of the substrate so that a relatively top series forms a projecting lip along one of said edges and a relatively bottom series forms a complimentary shoulder along the other of said edges, to enable a plurality of the sections to be abutted edge to edge of one another in coplanar array, with a waterproof lap joint thus formed therebetween.

The lip may project from the aforesaid one edge of the substrate a distance substantially equal to the width of the shoulder formed along the other edge, so that the lip of one section substantially covers the shoulder of an adjacent section when a plurality of the sections are abutted edge to edge of one another in coplanar array. Moreover, the bottom series of roof plates may extend across the substrate from the aforesaid one edge of the same to the other; or the bottom series may extend adjacent only the aforesaid other edge of the substrate, that is, the edge having the shoulder therealong. Furthermore, in the latter instance, the top of the substrate may be transversely stepped and the bottom series of roof plates may be disposed in the rabbet of the step, and the top series may be disposed on the land of the step, in overlapping relationship with the bottom series.

Where the roof plates have opposing faces and opposing ends, one of which faces is tapered to the ends so as to form a butt end and a feathered end, respectively, on each plate, the plates in the bottom series may be inverted so that the other faces of the same are disposed relatively upwardly in the series, and the feathered ends of the plates may be directed relatively oppositely to those of the plates in the top series, but in overlapping relationship with the butt ends of the adjacent plates in the bottom series.

The substrate may have means on the bottom thereof which cooperate with the lip of the roof covering to form a groove along the aforesaid one edge of the substrate; and the groove forming means may terminate short of the other edge of the substrate, so as to form a tongue on the latter edge which is interengagable with the groove of the adjacent roof section when a plurality of the sections are mounted in coplanar array as indicated. Preferably, however, the tongue terminates short of the bottom of the groove, so that there is a clearance between the tongue and the goove within which a sealant material or a sealing device may be interposed to add to the waterproofing effect of the joint between sections.

The substrate may comprise a single elongated strip; or it may comprise a plurality of spaced parallel rigidly interconnected strips. Also, in such a case, the tongue and groove forming means may take the form of a panel-like backing for the strips; or it may take the form of batt-like reinforcing members for the strips. Where it takes the form of a panel-like backing, the backing may be hollow or solid; and where the backing is hollow, it may be open topped and the strips may be spaced apart from one another to allow for air circulation within the substrate. Where the tongue and groove forming means takes the form of batt-like reinforcing members, the members are normally disposed crosswise of the strips and spaced apart from one another; and the strips are normally interconnected edge to edge of one another, as for example by tongue and groove joints therebetween.

According to another feature of the invention, the roof section may further comprise means on the bottom of the substrate which define a pair of spaced parallel depending surfaces thereon that are disposed crosswise of the aforesaid edges of the substrate and oriented in one direction lengthwise of the series of plates in the roof covering, so that when the roof section is obliquely mounted on a building structure, the depending surfaces of the same can be abutted against a pair of relatively vertically and horizontally spaced stops on the structure, to support the section while it is secured to the structure from points below the section, that is, from points within the building structure itself. Preferably, the depending surfaces of the roof section are defined by a pair of cleat-like projections on the bottom of the substrate which have faces thereon that are oriented in the opposite direction lengthwise of the series of plates in the roof covering so that fasteners such as nails can be driven through the projections into the stops to secure the roof section to the building structure.

The projections may also serve as the batt-like reinforcing members mentioned above.

The stops on the building structure may be defined by a pair of molding strips which are secured to the tops of horizontally extending supports in the structure. The molding strips may take the form of upright wedges, in which case the bottom of the substrate may be rested against one face of the respective wedges while the relatively downwardly oriented side faces of the projections are rested against the other. Alternatively, the molding strips may have inverted wedge-shaped recesses therein, in which case the end faces of the projections may be rested against one surface of the respective recesses while the relatively downwardly oriented side faces of the projections are rested against the other surface of the respective recesses.

In one of the presently preferred embodiments of the invention, the substrate comprises a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate. The endmost cross members also have grooves therein which coincide with the bottom plane of the frame, and the substrate further comprises a sheet-like finish covering on the bottom of the frame, the ends of which are interengaged in the grooves of the endmost cross members.

A step is formed on the top of the substrate by a series of spaced parallel furring strips which extend on parallels to the rafter-like members, with the furring strip adjacent the rafter-like member on the aforesaid other side edge of the substrate being shallower than the remaining furring strips so as to form the rabbet of the step, and projecting beyond the relatively outside edge of the latter member so as to form a tongue thereon as well. The series of strips also terminates short of the relatively outside edge of the rafter-like member on the aforesaid one side edge of the substrate, so as to form a groove therealong.

Insulation may be added to the spaces defined within the frame by the bottom covering, the respective cross members, the rafter-like members, and the furring strips. Also, the relatively outside edge of one of the rafter-like members may be rabbetted to form a race between sections for electrical wire and the like.

BRIEF DESCRIPTION OF THE DRAWINGS

These features will be better understood by reference to the accompanying drawings which illustrate several of the presently preferred embodiments of the invention.

In the drawings,

FIG. 5 is a cross sectional view of another embodiment of the roof section;

FIG. 6 is a part cross sectional view of the joint between a pair of the latter sections when they are interengaged in coplanar array;

FIG. 7 is a part cross sectional view of the array when the sections are mounted in the manner of FIG. 3;

FIG. 8 is a cross sectional view of a third embodiment of the roof section; and FIG. 9 is a cross sectional view of a fourth embodiment of the roof section.

DESCRIPTION OF THE PREFERRED EMBODIMENT

Figure 1:
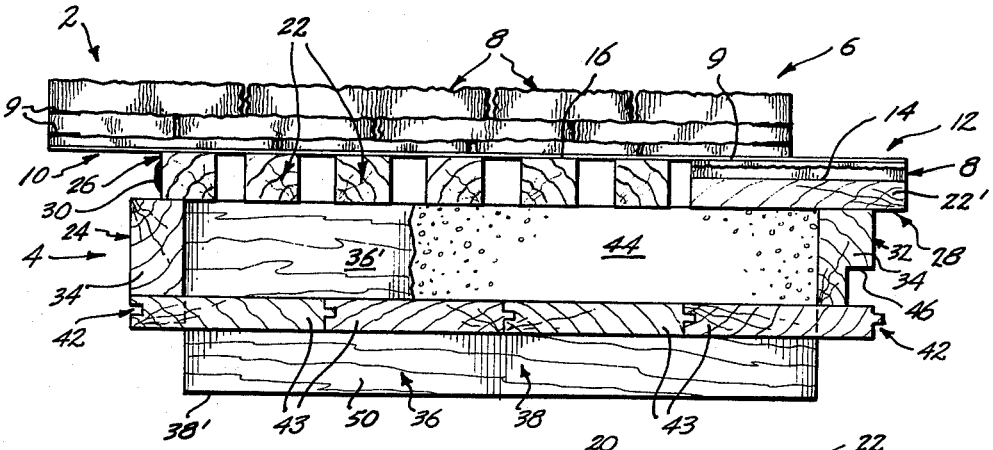
FIG. 1 is a cross sectional view of the above mentioned one embodiment of the roof section.
Figure 2:
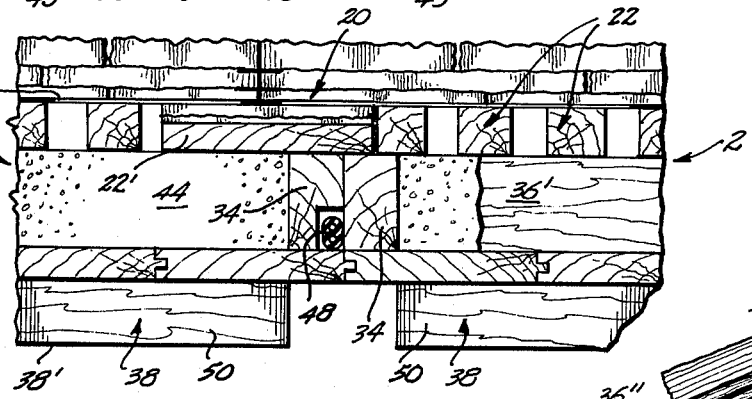
FIG. 2 is a part cross sectional view of the joint made between a pair of such sections when they are interengaged in coplanar array.
Figure 3:
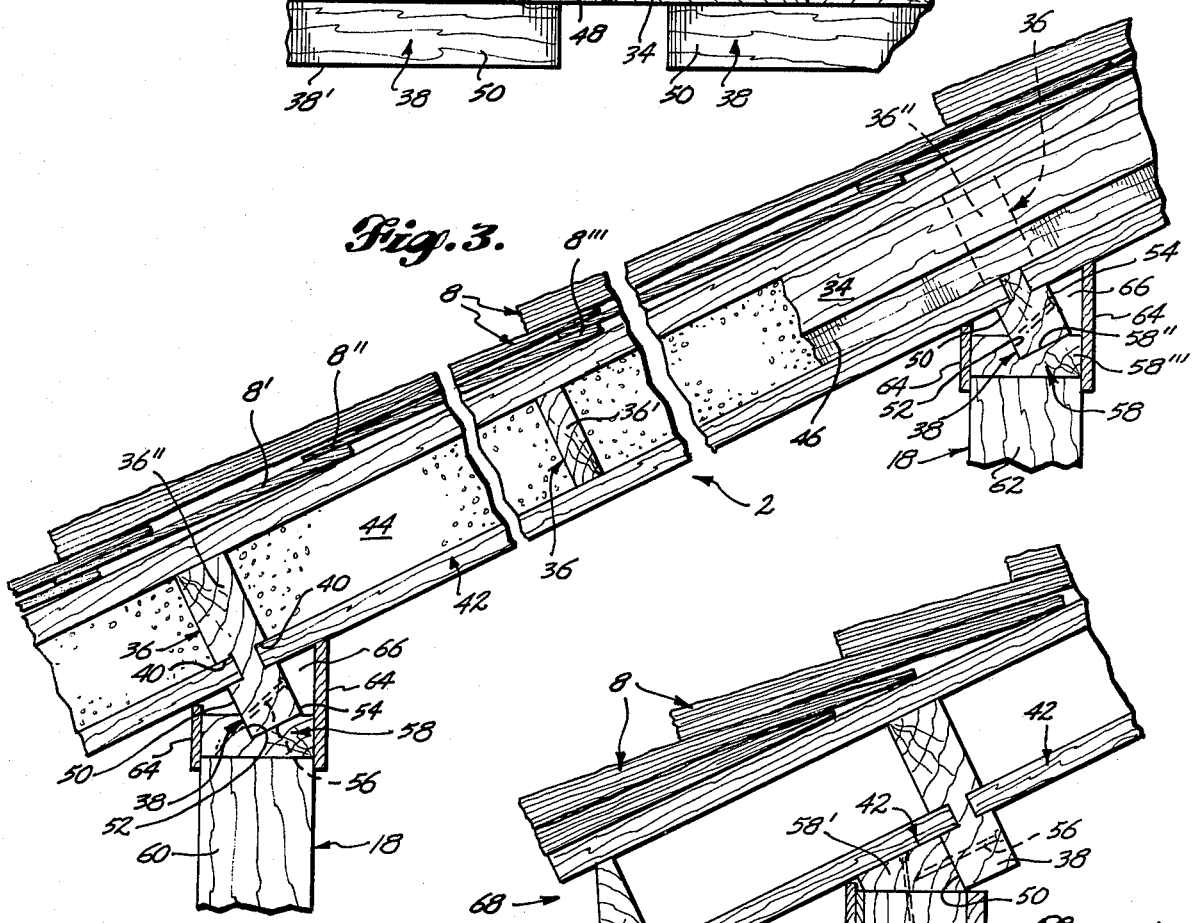
FIG. 3 is a part cross sectional view of the array when the sections are obliquely mounted on a building structure having recessed molding strips as stops therein.

Referring to the drawings and firstly, to FIGS. 1–3 in particular, it will be seen that the roof section 2 comprises a substrate 4 of stiff, sheathing-like material, having a quadrilateral outline and a roof covering 6 on the top thereof which comprises a plurality of relatively offset but overlapping shingle-like roof plates 8 with layers of roofing felt 9 therebetween. The plates are arranged in two parallel, relatively transversely offset but overlapping series of the same, that are superposed over one another and the substrate, respectively, so as to form a projecting lip 10 (FIG. 1) along one edge of the roof section (the left-hand in FIG. 1) and a complementary shoulder 12 along the opposing or other edge thereof (the right-hand in FIG. 1). For this purpose, the top of the substrate is stepped and the bottom series of roof plates is disposed in the rabbet 14 of the step and the top series on the land 16 thereof, in overlapping relationship with the bottom series as indicated. Moreover, since the roof plates consist of common wood shingles, the plates in the bottom series are inverted so that the untapered faces 8' of the same (FIG. 3) are disposed relatively upwardly in the series, and the feathered ends 8'' of the plates are directed relatively oppositely to those of the plates in the top series, but in overlapping relationship to the butt ends 8''' of the adjacent plates in the bottom series. In this way, the bottom series forms a relatively substantially planar upper surface, while the plates in the top series are disposed and arranged to shed water in conventional fashion.

In use, the roof section is obliquely mounted on a building structure 18 (FIG. 3) with one or more other such sections in a coplanar array of the same, and a waterproof joint is formed between each pair of sections by interengaging the lip 10 of one section with the shoulder 12 of the next to form a lap joint 20 between the roof coverings 6 of the respective sections. See FIG. 2.

The substrate 4 comprises a plurality of spaced parallel elongated strips 22 of wood which are rigidly interconnected by a panel-like backing 24 for the same. The backing also cooperates with the lip 10 of the roof covering to form a groove 26 along the aforesaid one edge of the substrate; and in addition, terminates short of the other edge thereof so as to form a tongue 28 on the latter edge which is interengagable with the groove 26 of the adjacent roof section when a plurality of the sections are mounted in coplanar array as in FIG. 2. Preferably, however, the tongue 28 terminates short of the bottom of the groove 26 so that there is a clearance between the tongue and the groove within which a sealant material 30 (or a sealing device) may be interposed to add to the waterproofing effect of the joint between sections.

The backing 24 is hollow and open topped, and the strips 22 are spaced apart from one another to allow for air circulation within the substrate. More specifically, the substrate comprises a rectangular frame 32 having a pair of rafter-like wood members 34 along the side edges thereof and three spaced parallel wood cross members 36 therebetween. The intermediate cross member, 36', is flush with the top and bottom planes of the frame, and the endmost cross members, 36'', are flush with the top plane of the frame, but depend below the bottom plane of the same to form cleat-like projections 38 on the bottom of the substrate. The endmost cross members 36'' also have grooves 40 therein which coincide with the bottom plane of the frame, and the substrate further comprises a sheet-like finish covering 42 of wood on the bottom of the frame, the ends of which are interengaged in the grooves 40 of the endmost cross members. The covering may be monolithic or it may comprise tongue and groove planking 43 or the like as shown.

The strips 22 on the top of the backing take the form of wood furring strips which extend on parallels to the rafter-like members 34. The furring strip 22' adjacent the rafter-like member on the aforesaid other side edge of the substrate is shallower than the remaining furring strips so as to form the rabbet 14 of the step, and in addition, projects beyond the relatively outside edge of the latter member so as to form the tongue 28 on that side edge as well. The series of strips also terminates short of the relatively outside edge of the rafter-like member on the aforesaid one side edge of the substrate so as to form the groove 26 therealong.

Insulation 44 is added to the spaces defined within the frame by the bottom covering 42, the respective cross members 36, the rafter-like members 34 and the furring strips 22. Also, the relatively outside edge of the right-hand rafter-like member 34 is rabbeted to form a race 46 (FIG. 1) between sections for electrical wire 48 and the like (FIG. 2).

The cleat-like projections 38 on the bottom of the substrate define a pair of spaced parallel depending surfaces 50 (FIGS. 1 and 2) thereon that are disposed crosswise of the side edges of the substrate and oriented in one direction lengthwise of the series of plates in the roof covering, so that when the roof section is obliquely mounted on the building structure 18, the depending surfaces 50 of the same can be abutted against a pair of relatively vertically and horizontally spaced stops 52 (FIG. 3) on the structure, to support the section while it is secured to the structure from points below the section, that is, from points within the building structure itself. Also, the cleat-like projections have faces 54 thereon that are oriented in the opposite direction lengthwise of the series of plates in the roof covering so that fasteners such as nails 56 can be driven through the projections into the stops to secure the roof section to the building structure.

The stops 52 on the building structure are defined by a pair of molding strips 58 which are secured to the tops of horizontally extending supports in the structure, such as the wall 60 and beam 62 in FIG. 3. The molding strips may take the form of upright wedges 58', as in FIG. 4, in which case the bottom 42 of the substrate rests against one face of the respective wedges while the relatively downwardly oriented side faces 50 of the projections rest against the other. Alternatively, the molding strips may have inverted wedge-shaped recesses 58'' therein, as in FIG. 3, whereupon the end faces 38' (FIGS. 1 and 2) of the projections rest against one surface of the respective recesses while the relatively downwardly oriented side faces 50 of the projections rest against the other surface of the respective recesses.

The recessed molding strips 58''' in FIG. 3 provide a construction whereby facia strips 64 can be applied to the sides of the molding strips, not only to house or box in each molding strip for a more finished construction, but also to provide a cavity or cavities 66 within which electrical wire or the like can be run horizontally of the roof.

Figure 4:
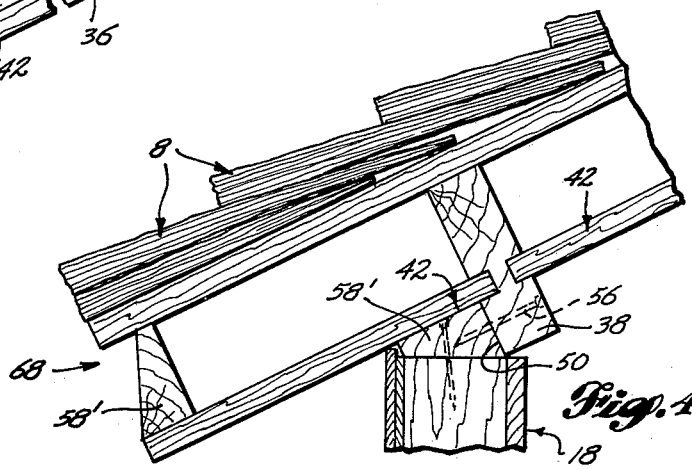
FIG. 4 is a part cross sectional view of the array when the sections are mounted on a structure having wedge shaped strips as stops.

As seen in FIG. 4, the molding strips 58' may be used also to finish off the ends of the roof section, both at the eaves of the roof and at the ridge of the roof. However, only the eaves 68 are shown to illustrate this feature.

In the embodiment of FIGS. 5–7, the substrate 70 again comprises a plurality of spaced parallel strips 72, but in this case, the strips 72 are more plank-like in construction and are rigidly interconnected by batt-like reinforcing members 74 for the same. The reinforcing members 74 are disposed crosswise of the strips and spaced apart from one another; and the strips 72 are interconnected edge to edge of one another, as for example by tongue and groove joints 76 therebetween. The reinforcing members 74 also cooperate with the lip 78 of the roof covering 80 to form a groove 82 along the aforesaid one side edge of the substrate; and terminate short of the other side edge of the substrate so that the adjacent strip 72' forms a tongue 84 thereon which is interengagable with the groove 82 of the adjacent roof section when a plurality of the sections are mounted in coplanar array as in FIG. 6. Additionally, the tongue forming strip 72' is shallower than the remainder of the strips so as to form the rabbet of the step for the bottom course of shingle-like roof plates 8. However, the bottom course of roof plates is narrower than the tongue-forming strip 72' so that the tongue 86 on the strip remains to engage in the groove 88 of the adjacent roof section, when the sections are interengaged with one another.

As seen in FIG. 7, the reinforcing members 74 also serve as cleat-like projections for the mounting and securing operations.

Again, sealant material 30 may be added at each joint 20.

In FIG. 8, the substrate 90 comprises a single elongated strip 72, and the bottom series of the shingle-like roof plates 8 extends across the substrate from the aforesaid one side edge of the same to the other.

In FIG. 9, the substrate 92 comprises a plurality of elongated strips 72, but one of the strips, 72'', is sufficiently narrow that the series of roof plates provide reinforcement crosswise of them. However, corrugated fasteners 94 are added at the tongue and groove joint 76 between the strips, to aid in stiffening and securing the assembly.

What is claimed is:

1. A prefabricated roof section comprising a substrate of stiff sheathing-like material having a quadrilateral outline and a roof covering on the top thereof which comprises a plurality of shingle-like roof plates, the bodies of which have a tapering cross section in one cross sectional plane thereof, said plates being arranged on the substrate in at least two elongated parallel, relatively transversely offset but overlapping relatively top and bottom series, each of which has a plurality of the plates therein, said plates being arranged in each series so that the bodies of the plates are staggered in overlapping relationship to one another lengthwise of the series and the tapering cross sections of the plates are disposed lengthwise of the series, and said series being arranged between unidirectional edges of the substrate so that a relatively top series forms a projecting lip along one of said edges and a relatively bottom series forms a complementary shoulder along the other of said edges, to enable a plurality of the sections to be abutted edge to edge of one another in coplanar array, with a waterproof lap joint thus formed therebetween.

2. The prefabricated roof section according to claim 1 wherein the bottom series of roof plates extends across the substrate from the aforesaid one edge of the same to the other.

3. The prefabricated roof section according to claim 1 wherein the bottom series of roof plates extends adjacent the aforesaid other side of the substrate.

4. The prefabricated roof section according to claim 3 wherein the top of the substrate is transversely stepped and the bottom series of roof plates is disposed in the rabbett of the step, and the top series on the land of the step in overlapping relationship with the bottom series.

5. The prefabricated roof section according to to claim 1 wherein the roof plates have opposing faces and opposing ends, one of which faces is tapered to the ends so as to form a butt end and a feathered end respectively on each plate, and wherein the plates in the bottom series are inverted so that the other faces of the same are disposed relatively upwardly in the series, and the feathered ends of the plates are directed relatively oppositely to those of the plates in the top series, but in overlapping relationship with the butt ends of the adjacent plates in the bottom series.

6. The prefabricated roof section according to claim 1 wherein the substrate has means on the bottom thereof which cooperate with the lip of the roof covering to form a groove along the aforesaid one edge of the substrate, and the groove forming means terminates short of the other edge of the substrate so as to from a tongue on the latter edge which is interengagable with the groove of the adjacent roof section when a plurality of the sections are interconnected in coplanar array.

7. The prefabricated roof section according to claim 6 wherein the tongue is adapted to terminate short of the bottom of the groove so that there is a clearance between the tongue and the groove when the sections are so interconnected, within which a sealing material or a sealing device may be interposed to add to the waterproofing effect of the joint between sections.

8. The prefabricated roof section according to claim 6 wherein the substrate comprises a plurality of spaced parallel rigidly interconnected strips of sheathing material and the tongue and groove forming means takes the form of a panel-like backing for the strips.

9. The prefabricated roof section according to claim 8 wherein the backing is hollow and open-topped and the strips are spaced apart from one another to allow for air circulation within the substrate.

10. The prefabricated roof section according to claim 6 wherein the substrate comprises a plurality of spaced parallel strips of sheathing material which are rigidly interconnected edge to edge of one another, and the tongue and groove forming means takes the form of batt-like reinforcing members for the strips, which are disposed crosswise of the strips and spaced apart from one another.

11. The prefabricated roof section according to claim 1 wherein the substrate comprises a single elongated strip of sheathing material.

12. The prefabricated roof section according to claim 1 wherein the substrate comprises a plurality of spaced parallel rigidly interconnected strips of sheathing material.

13. The prefabricated roof section according to claim 1 further comprising means on the bottom of the substrate which define a pair of spaced parallel depending surfaces thereon that are disposed crosswise of the aforesaid edges of the substrate and oriented in one direction lengthwise of the courses of the roof covering so that when the roof section is obliquely mounted on a building structure, the depending surfaces of the same can be abutted against a pair of relatively vertically and horizontally spaced stops on the structure to support the section while it is secured to the structure from points below the section.

14. The prefabricated roof section according to claim 1 wherein the lip projects from said one edge of the substrate a distance substantially equal to the width of the shoulder formed along said other edge, so that the lip of one section substantially covers the shoulder of an adjacent section when a plurality of the sections are abutted edge to edge of one another in coplanar array.

15. A prefabricated roof section comprising a substrate of stiff sheathing-like material having a quadrilateral outline and a roof covering on the top thereof which comprises a series of relatively offset but overlapping shingle-like roof plates that are arranged in two parallel relatively transversely offset but overlapping courses of the same that are superposed over one another and the substrate, respectively, so as to form a projecting lip along one side edge of the roof section and a complementary shoulder along the opposing side edge thereof, said substrate comprising a quadrilateral frame having a pair of rafter-like members along the side edges thereof corresponding to the aforesaid side edges of the roof section, which are flush with the top plane of the frame but depend below the bottom plane of the same to form cleat-like projections on the bottom of the substrate, there being a sheet-like covering on the bottom of the substrate, flush with the bottom plane of the frame between said cross members.

16. A prefabricated roof section comprising a substrate of stiff sheathing-like material having a quadrilateral outline and a roof covering on the top thereof which comprises a series of relatively offset but overlapping shingle-like roof plates that are arranged in two parallel relatively transversely offset but overlapping courses of the same that are superposed over one another and the substrate, respectively, so as to form a projecting lip along one side edge of the roof section and a complementary shoulder along the opposing side edge thereof, means on the bottom of the substrate which define a pair of spaced parallel depending surfaces thereon that are disposed crosswise of the aforesaid side edges of the substrate and oriented in one serial direction of the roof covering so that when the roof section is obliquely mounted on a building structure, the depending surfaces of the same can be abutted against a pair of relatively vertically and horizontally spaced stops on the structure to support the section while it is secured to the structure from points below the section, the depending surfaces of the roof section being defined by a pair of cleat-like projections on the bottom of the substrate which have faces thereon that are oriented in the opposite serial direction of the roof covering so that fasteners can be driven through the projections into the stops to secure the roof section to the building structure, and said substrate comprising a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate, there being grooves in the endmost cross members which coincide with the bottom plane of the frame, and a sheet-like covering on the bottom of the frame, the ends of which are interengaged in the grooves of the endmost cross members.

17. A preabricated roof section comprising a substrate of stiff sheathing-like material having a quadrilateral outline and a roof covering on the top thereof which is adapted to shed water in one axial direction of the substrate, means on the bottom of the substrate which define a pair of spaced parallel depending surfaces thereon that are disposed crosswise of the substrate and oriented in the same axial direction as the roof covering so that when the roof section is obliquely mounted on a building structure the depending surfaces of the same can be abutted against a pair of relatively vertically and horizontally spaced stops on the structure to support the section while it is secured to the structure from points below the section, the depending surfaces on the roof section being defined by a pair of cleat-like projections on the bottom of the substrate which have faces thereon that are oriented in the opposite axial direction of the substrate so that fasteners can be driven through the projections into the stops to secure the roof section to the building structure, and said substrate comprising a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate, there being grooves in the endmost cross members which coincide with the bottom plane of the frame, and a sheet-like covering on the bottom of the frame, the ends of which are interengaged in the grooves of the endmost cross members.

18. A prefabricated roof section comprising a substrate of stiff sheathing-like material having a quadrilateral outline and roof covering on the top thereof which is adapted to shed water in one axial direction of the substrate, said substrate comprising a quadrilateral frame having a pair of rafter-like members along the side edges thereof co-parallel with the aforesaid one axial direction of the substrate, and spaced parallel cross members therebetween, which are flush with the top plane of the frame but depend below the bottom plane of the same to form cleat-like projections on the bottom of the substrate, there being a sheet-like covering on the bottom of the substrate, flush with the bottom plane of the frame between said cross members.

19. A building structure having a roof section obliquely mounted thereon, comprising a substrate of stiff sheathing-like material having a quadrilateral outline and a roof covering on the top thereof which is adapted to shed water in the downwardly oblique direction of the substrate, said substrate comprising a quadrilateral frame having a pair of rafter-like members along the oblique edges thereof, and spaced parallel cross members therebetween, which are flush with the top plane of the frame but depend below the bottom plane of the same to form cleat-like projections on the bottom of the substrate, there being a sheet-like covering on the bottom of the substrate, flush with the bottom plane of the frame between said cross members.

20. A prefabricated roof section comprising a substrate of stiff sheathing-like material having a quadrilateral outline and a roof covering on the top thereof which comprises a plurality of shingle-like roof plates, the bodies of which have a tapering cross section in one cross sectional plane thereof, said plates being arranged on the substrate in at least two parallel, relatively transversely offset but overlapping relatively top and bottom courses, each of which has the plates arranged therein so that the bodies of the plates are staggered in overlapping relationship to one another lengthwise of the course and the tapering cross sections of the plates are disposed lengthwise of the course, and said courses being arranged between unidirectional edges of the substrate so that a relatively top course forms a projecting lip along one of said edges and a relatively bottom course forms a complementary shoulder along the other of said edges, to enable a plurality of the sections to be abutted edge to edge of one another in coplanar array, with a waterproof lap joint thus formed therebetween, there being means on the bottom of the substrate which define a pair of spaced parallel depending surfaces thereon that are disposed crosswise of the aforesaid edges of the substrate and oriented in one direction lengthwise of the courses of the roof covering so that when the roof section is obliquely mounted on a building structure, the depending surfaces of the same can be abutted against a pair of relatively vertically and horizontally spaced stops on the structure to support the section while it is secured to the structure from points below the section, the depending surfaces of the roof section being defined by a pair of cleat-like projections on the bottom of the substrate which have faces thereon that are oriented in the opposite direction of the roof covering so that fasteners can be driven through the projections into the stops to secure the roof section to the building structure, said substrate comprising a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate, there being grooves in the endmost cross members which coincide with the bottom plane of the frame and a sheet-like covering on the bottom of the frame, the ends of which are interengaged in the grooves of the endmost cross members.

21. The prefabricated roof section according to claim 20 wherein there is a step on the top of the substrate formed by a series of spaced parallel furring strips which extend on parallels to the rafter-like members, with the furring strip adjacent the rafter-like member on the aforesaid other edge of the substrate being shallower than the remaining furring strips so as to form the rabbett of the step, and projecting beyond the relatively outside edge of the latter member so as to form a tongue thereon, said series of strips terminating short of the relatively outside edge of the rafter-like member on the aforesaid one edge of the substrate, so as to form a groove therealong, and the bottom course being disposed in the rabbett of the step, and the top course on the land of the step on overlapping relationship with the bottom course.

22. A building structure having a roof section obliquely mounted thereon, comprising a substrate of stiff sheathing-like material having a quadrilateral outline and a roof covering on the top thereof which comprises a plurality of shingle-like roof plates, the bodies of which have a tapering cross section in one cross sectional plane thereof, said plates being arranged on the substrate in at least two parallel, relatively transversely offset but overlapping relatively top and bottom courses extending obliquely of the structure, each of which courses has the plates arranged therein so that the bodies of the plates are staggered in overlapping relationship to one another lengthwise of the course and the tapering cross sections of the plates are disposed lengthwise of the course, and said courses being arranged between the oblique edges of the substrate so that a relatively top course forms a projecting lip along one of said edges and a relatively bottom course forms a complementary shoulder along the other of said edges, there being a pair of relatively vertically and horizontally spaced stops on the structure, and means on the bottom of the substrate which define a pair of spaced parallel depending surfaces thereon that are disposed crosswise of the oblique edges of the substrate and oriented in one oblique direction of the roof covering, in abutment against the pair of stops, the depending surfaces of the roof section being defined by a pair of cleat-like projections on the bottom of the substrate which have faces thereon that are oriented in the opposite oblique direction of the roof covering, and there being fasteners driven through the projections into the stops securing the roof section to the building structure, said substrate comprising a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate, there being grooves in the endmost cross members which coincide with the bottom plane of the frame, and a sheet-like covering on the bottom of the frame, the ends of which are interengaged in the grooves of the endmost cross members.

23. A building structure having a roof section obliquely mounted thereon, comprising a substrate of stiff sheathing-like material having a quadrilateral outline and a roof covering on the top thereof which comprises a plurality of shingle-like roof plates, the bodies of which have a tapering cross section in one cross sectional plane thereof, said plates being arranged on the substrate in at least two elongated parallel, relatively transversely offset but overlapping relatively top and bottom series extending obliquely of the structure, each of which series has a plurality of the plates therein, said plates being arranged in each series so that the bodies of the plates are staggered in overlapping relationship to one another lengthwise of the series and the tapering cross sections of the plates are disposed lengthwise of the series, and said series being arranged between the oblique edges of the substrate so that a relatively top series forms a projecting lip along one of said edges and a relatively bottom series forms a complementary shoulder along the other of said edges.

24. The building structure according to claim 23 wherein the top of the substrate is transversely stepped and the bottom series of roof plates is disposed in the rabbett of the step, and the top series on the land of the step in overlapping relationship with the bottom series.

25. The building structure according to claim 23 wherein the roof plates have (a tapering cross section and) opposing faces and opposing ends, one of which faces is tapered to the ends so as to form a butt end and a feathered end respectively on each plate, and wherein the plates in the bottom series are inverted so that the (untapered) other faces of the same are disposed relatively upwardly in the series, and the feathered ends of the plates are directed relatively oppositely to those of the plates in the top series, but in overlapping relationship with the butt ends of the adjacent plates in the bottom series.

26. The building structure according to claim 23 wherein a plurality of the sections are interconnected in coplanar array, each substrate having means on the bottom thereof which cooperate with the lip of the roof covering to form a groove along the aforesaid one side edge of the substrate, and the groove forming means terminates short of the other side edge of the substrate so as to form a tongue on the latter edge which is interengaged with the groove of the adjacent roof section.

27. The building structure according to claim 26 wherein the tongue terminates short of the bottom of the groove and there is a sealing material or device in the clearance between the tongue and the groove.

28. The building structure according to claim 23 wherein there is a pair of relatively vertically and horizontally spaced stops on the structure, and means on the bottom of the substrate which define a pair of spaced parallel depending surfaces thereon that are disposed crosswise of the (side) oblique edges of the substrate and oriented in one (serial) oblique direction of the roof covering, in abutment against the pair of stops.

29. The building structure according to claim 23 wherein a plurality of the sections are interconnected in coplanar array at the oblique edges of the substrates, and the lips of the respective sections project from the aforesaid one edges thereof a distance substantially equal to the width of the shoulders formed along the aforesaid other edges thereof, so that the lip of each section substantially covers the shoulder of the adjacent section.

30. A building structure having a roof section obliquely mounted thereon, comprising a substrate of stiff sheathing-like material having a quadrilateral outline and a roof covering on the rooftop thereof which comprises a series of relatively offset but overlapping shingle-like roof plates that are arranged in two parallel relatively transversely offset but overlapping courses of the same that are superposed over one another and the substrate, respectively, so as to form a projecting lip along one side edge of the roof section and a complementary shoulder along the opposing side edge thereof, there being a pair of relatively vertically and horizontally spaced stops on the structure, and means on the bottom of the substrate which define a pair of spaced parallel depending surfaces thereon that are disposed crosswise of the side edges of the substrate and oriented in one serial direction of the roof covering, in abutment against the pair of stops, said depending surfaces of the roof section being defined by a pair of cleat-like projections on the bottom of the substrate which have faces thereon that are oriented in the opposite serial direction of the roof covering, and there being fasteners driven through the projections into the stops securing the roof section to the building structure, said substrate comprising a quadrilateral frame having a pair of rafter-like members along the side edges thereof and three spaced parallel cross members therebetween, the intermediate of which is flush with the top and bottom planes of the frame, and the endmost of which are flush with the top plane of the frame but depend below the bottom plane of the same to form the cleat-like projections on the bottom of the substrate, there being grooves in the endmost cross members which coincide with the bottom plane of the frame, and a sheet-like covering on the bottom of the frame, the ends of which are interengaged in the grooves of the endmost cross members.

31. The building structure according to claim 30 wherein there is a step on the top of the substrate formed by a series of spaced parallel furring strips which extend on parallels to the rafter-like members, with the furring strip adjacent the rafter-like member on the aforesaid other edge of the substrate being shallower than the remaining furring strips so as to form the rabbet of the step, and projecting beyond the relatively outside edge of the latter member so as to form a tongue thereon, said series of strips terminating short of the relatively outside edge of the rafter-like member on the aforesaid one edge of the substrate so as to form a groove therealong, and the bottom course being disposed in the rabbett of the step, and the top course on the land of the step in overlapping relationship with the bottom course.

32. The building structure according to claim 30 wherein there are horizontally extending supports in the structure and the stops are defined by a pair of molding strips which are secured to the tops of the supports.

33. The building structure according to claim 32 wherein the depending surfaces of the roof section are defined by cleat-like projections on the bottom of the substrate, the molding strips take the form of upright wedges, the bottom of the substrate bears against one face of the respective wedges, and the relatively downwardly oriented side faces of the projections bear against the other face of the respective wedges.

34. The building structure according to claim 32 wherein the depending surfaces of the roof section are defined by cleat-like projections on the bottom of the substrate, the molding strips have inverted wedge-shaped recesses therein, the end faces of the projections bear against one surface of the respective recesses, and the relatively downwardly oriented side faces of the projections bear against the other surface of the respective recesses.

* * * * *

UNITED STATES PATENT AND TRADEMARK OFFICE

CERTIFICATE OF CORRECTION

PATENT NO. : 4107885

DATED : August 22, 1978

INVENTOR(S) : Sir Walter Lindal

It is certified that error appears in the above-identified patent and that said Letters Patent are hereby corrected as shown below:

Claim 3, line 3 thereof, "side" should be "edge".

Claim 6, line 6 thereof, "from" should be "form".

Claim 25, lines 2 and 3 thereof, "(a tapering cross section and)" should be omitted; line 7 thereof, "(untapered)" should be omitted.

Claim 28, line 6 thereof, "(side)" should be omitted; line 7 thereof, "(serial)" should be omitted.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*